United States Patent [19]

Maruko

[11] Patent Number: 5,069,169

[45] Date of Patent: Dec. 3, 1991

[54] TUBE-IN-SHELL HEATING APPARATUS

[75] Inventor: Saburo Maruko, Yamato, Japan

[73] Assignee: Nippon Chemical Plant Consultant Co., Ltd., Tokyo, Japan

[21] Appl. No.: 613,736

[22] PCT Filed: Mar. 27, 1990

[86] PCT No.: PCT/JP90/00408

§ 371 Date: Nov. 26, 1990

§ 102(e) Date: Nov. 26, 1990

[87] PCT Pub. No.: WO90/11473

PCT Pub. Date: Apr. 10, 1990

[30] Foreign Application Priority Data

Mar. 27, 1989 [JP] Japan ..... 1-71862

[51] Int. Cl.[5] ..... F22B 1/02

[52] U.S. Cl. ..... 122/33; 165/161

[58] Field of Search ..... 122/32, 33, 18, 155.2, 122/5; 165/159, 161

[56] References Cited

U.S. PATENT DOCUMENTS

| | | | |
|---|---|---|---|
| 3,273,542 | 9/1966 | Griffith | 122/33 |
| 3,766,892 | 10/1973 | Webster | 122/32 |
| 3,827,484 | 8/1974 | Wolowodiuk | 122/32 |
| 3,916,990 | 11/1975 | Ruhe et al. | 122/32 X |
| 4,256,783 | 3/1981 | Takada et al. | 165/161 X |
| 4,768,580 | 9/1988 | Ferguson | 165/161 X |

FOREIGN PATENT DOCUMENTS

| | | |
|---|---|---|
| 57-210205 | 12/1982 | Japan . |
| 60-114603 | 6/1985 | Japan . |

*Primary Examiner*—Edward G. Favors

*Attorney, Agent, or Firm*—Armstrong, Nikaido, Marmelstein, Kubovcik & Murray

[57] ABSTRACT

The present invention relates to a heating apparatus having an object to form a construction of high thermal efficiency so that a heat transfer area of a surface to be heated in a heating chamber may be made small so as to miniaturize the whole equipment, and to utilize the whole quantity of supplied oxygen effectually thereby to suppress generation of polution materials. The heating equipment has a combustion gas inflow port (19) and an exhaust gas outlet (14*a*) at the bottom portion and in the vicinity of an upper opening end, respectively, and is provided with a heating chamber (14) installed with a cover body (4) on the top portion thereof, a plurality of pipe bodies (11) which are supported by a can plate provided in the cover body (4) and hung vertically in the heating chamber, a plurality of buffle plates (16) which are penetrated with these pipe bodies and disposed so as to form a labyrinth ranging in upward and downward directions in the heating chamber, a main catalytic combustion equipment (18) connected to the combustion gas inflow port (19), a plurality sheets of partition plates (17) provided in the heating chamber so as to partition the labyrinth into a plurality of chambers in upward and downward directions and a plurality of auxiliary catalytic combustion equipments (21*a*, 21*b*) provided so as to connect both chambers on the down side and the up side of each of these partition plates.

9 Claims, 8 Drawing Sheets

TUBE-IN-SHELL HEATING APPARATUS

TECHNICAL FIELD OF THE INVENTION

The present invention relates to a heating apparatus or equipment for heating a reaction gas such as hydrogen and a fluid such as water to reaction, evaporation or predetermined temperature.

TECHNICAL BACKGROUND OF THE INVENTION

Conventionally, a heating equipment of this type utilizes radiant heat from flames obtained by combustion in one time and sensible heat of a combustion gas at a high temperature.

In such a conventional heating equipment, it raises the combustion temperature too high to control the temperature within permissible skin temperature of a heating pipe to utilize most of oxygen in the air for combustion. Thus, it has been impossible to suppress generation of pollution materials, viz., $NO_x$ and uncombustibles.

Thus, there has been no other method in a conventional combustion equipment but to elongate the length of combustion flames so as to bring the temperature of a combustion gas down to a low temperature.

Besides, there has been such a drawback that a heat exchanger becomes large in size when heat exchange is effected between combustion exhaust gas and blown air.

In case multi-stage contact combustion is utilized, there have been such drawbacks that a heating equipment has to be provided in each number of combustion times, that cost of the equipment becomes expensive, and that heat loss is increased because a surface area of the equipment is increased, thus degrading thermal efficiency.

SUMMARY OF THE INVENTION

It is an object of the present invention which has been made in view of circumstances described above to provide a heating equipment in which a heat transfer area of a surface to be heated in a heating chamber can be made small so that the whole heating equipment may be miniaturized and improvement of thermal efficiency can also be aimed at.

It is another object of the present invention to provide a heating equipment in which most of the whole quantity of oxygen in the air for combustion can be utilized and high thermal efficiency is obtainable while suppressing generation of pollution materials.

In order to achieve the objects described above, according to a first mode of the present invention, there is provided a heating equipment consisting of a heating chamber with a bottom having an opening portion in an upper part thereof, a cover body provided at the top portion of the heating chamber, a plurality of heat-exchanger pipe bodies inserted along a vertical direction at predetermined intervals in the heating chamber in diametral directions of the heating chamber, a can plate provided in the lower part of the cover body so as to block the opening portion of the heating chamber and also to support the pipe bodies, a plurality of sheets of baffle plates arranged so as to form a labyrinth stretching vertically in a row in the heating chamber and having the pipe bodies penetrate therethrough, a combustion gas inflow port provided at a bottom portion of the heating chamber or on a sidewall adjacent to the bottom portion and having an opening portion at the bottom portion of the heating chamber and an exhaust gas outflow port provided in an upper part of the heating chamber or on a sidewall adjacent to the upper part and having an opening portion in the upper part of the heating chamber, comprising a main catalytic combustion equipment located outside of the heating chamber and connected to the combustion gas inflow port, a plurality of partition plates provided in the heating chamber so as to partition the labyrinth into a plurality of chambers vertically, and a plurality of auxiliary catalytic combustion equipments provided so as to connect both chambers on the lower side and the upper side of respective partition plates.

According to a second mode of the present invention, there is provided a heating equipment described with respect to the first mode, characterized in that the main catalytic combustion equipment is composed of a first stage combustion equipment consisting of a first mixer for mixing preheated air and fuel with each other and a first combustion catalyzer disposed on a downstream side of a mixed gas outlet of the first mixer and a second stage combustion equipment consisting of a second mixer disposed on a downstream side of the first combustion catalyzer for mixing the combustion gas from the first stage combustion equipment and fuel with each other and a second combustion catalyzer disposed on a downstream side of the mixed gas outlet of the second mixer.

According to a third mode of the present invention, there is provided a heating equipment described with respect to the first mode, characterized in that each of the auxiliary catalytic combustion equipments is composed of a passage for flowing the combustion gas out of a chamber located under the partition plates, a mixer provided on the way of the passage so as to mix fuel with the outflow combustion gas, a combustion catalyzer arranged on a downstream side of a mixed gas outlet of the mixer, and a passage for having a heating combustion gas which has passed through the combustion catalyzer flow into a chamber located above the partition plates.

According to a fourth mode of the present invention, there is provided a heating equipment described with respect to the first mode, characterized in that the can plate has a stiffening rib on the underside thereof.

According to a fifth mode of the present invention, there is provided a heating equipment described with respect to the first mode, characterized in that the can plate consists of a first can plate provided in the vicinity of the lower end of the cover body so as to support upper parts of respective heat-exchanger pipe bodies fixedly and a second can plate provided in the cover body which is apart upwardly by a predetermined distance from the first can plate According to a sixth mode of the present invention, there is provided a heating equipment described with respect to the fifth mode, characterized in that each of the heat-exchanger pipe bodies consists of a heating outer pipe with a bottom which is fixedly attached to the first can plate at the upper end thereof so as to include upper opening ends in the same plane as the upper surface of the first can plate and hung vertically therefrom into the heating chamber and an inner pipe having an opened lower end which is fixedly attached to the second can plate at the upper end thereof so as to include the upper opening end in the same plane as the upper face of the second can plate and hung vertically therefrom into the heating outer pipe without making contact with this outer pipe.

According to a seventh mode of the present invention, there is provided a heating equipment described with respect to the sixth mode, characterized in that the inner pipe is provided with an inner pipe which is hung vertically inside the inner pipe from the upper opening end thereof without making contact with the inner pipe.

Furthermore, according to an eighth mode of the present invention, there is provided a heating equipment described with respect to the sixth mode, characterized in that the inner pipe is provided with an inserted inner pipe having opening ends at upper and lower ends which is hung inside the inner pipe from the upper opening end without making contact therewith, that a ring-shaped space formed between the inserted inner pipe and the inner pipe is blocked at least at the upper end thereof, and that the upper opening end of the heating outer pipe is communicated with a feed gas inflow side, and on the other side, the upper opening end of the inserted inner pipe is communicated with a reaction product gas outlet side, respectively.

Furthermore, according to a ninth mode of the present invention, there is provided a heating equipment described with respect to the eighth mode, characterized in that the inserted inner pipe is provided with a drawn portion formed on an inner circumferential surface at the lower end of the inserted inner pipe, a cooling medium chamber provided on the outside circumference of the drawn portion so as to communicate with the drawn portion through a nozzle, and a cooling medium pipe connected between the cooling medium chamber and a cooling medium supply pipe or supplying the cooling medium to the cooling medium chamber.

In the present invention having respective modes described above, the combustion gas which is made to flow in from the main catalytic combustion equipment is discharged from the exhaust gas outlet through the labyrinth in the heating chamber and heats the outer surface of heat-exchanger pipe bodies inserted into the heating chamber in the interim, thereby to heat the fluid in the pipe bodies. Thus, the combustion gas which passes through the labyrinth is burst and heated by the auxiliary catalytic combustion equipment while the gas flows from the underside to the top side of the partition plate which partitions the heating chamber in a vertical direction.

In the main catalytic combustion equipment, combustion at 750°-900° C. is effected in the first stage combustion equipment, and combustion at 1,250°-1,350° C. is effected in the second combustion equipment.

Preheated air and fuel are supplied to the mixer of the first stage combustion equipment of the main catalytic combustion equipment, and combustion gas and fuel on the upstream side are supplied to the mixer of other catalytic combustion equipments.

Feed gas flowing into heating outer pipes which form heat-exchanger pipe bodies reacts inside these heating outer pipes and is cooled by means of latent heat of vaporization of a cooling medium which is sprayed from a nozzle while passing through the inserted inner pipe immediately after reaction.

Therefore, according to the present invention, a heat transfer area of a surface to be heated in a heating chamber can be made small. With this, it is possible to contrive miniaturization of the whole heating equipment and also to device improvement of the thermal efficiency with less heat loss. It is further possible to utilize almost the whole quantity of oxygen in combustion air within a controlled combustion temperature and to suppress generation of pollution materials.

Furthermore, according to the present invention, upper ends of inner pipes composing heat-exchanger pipe bodies are closed, inserting inner pipes with upper and lower ends thereof opened are inserted into these inner pipes, drawn portions are provided at lower end portions of these inserting inner pipes, and these drawn portions are cooled. With this, the reaction product gas in the heating outer pipes which flows in from the opening portions of the heating outer pipes of the heat-exchanger pipe bodies is cooled immediately at the reaction terminating portion thereof, thus preventing side reactions of the reaction product gas.

Above-described and other objects, modes and advantages of the present invention will become apparent to those skilled in the art by explanation with reference to the following description and accompanying drawings in which preferred concrete exemplifications which are in accord with the principle of the present invention are shown as embodiments.

DETAILED DESCRIPTION OF THE PREFERRED EMBODIMENTS

Figure 1:
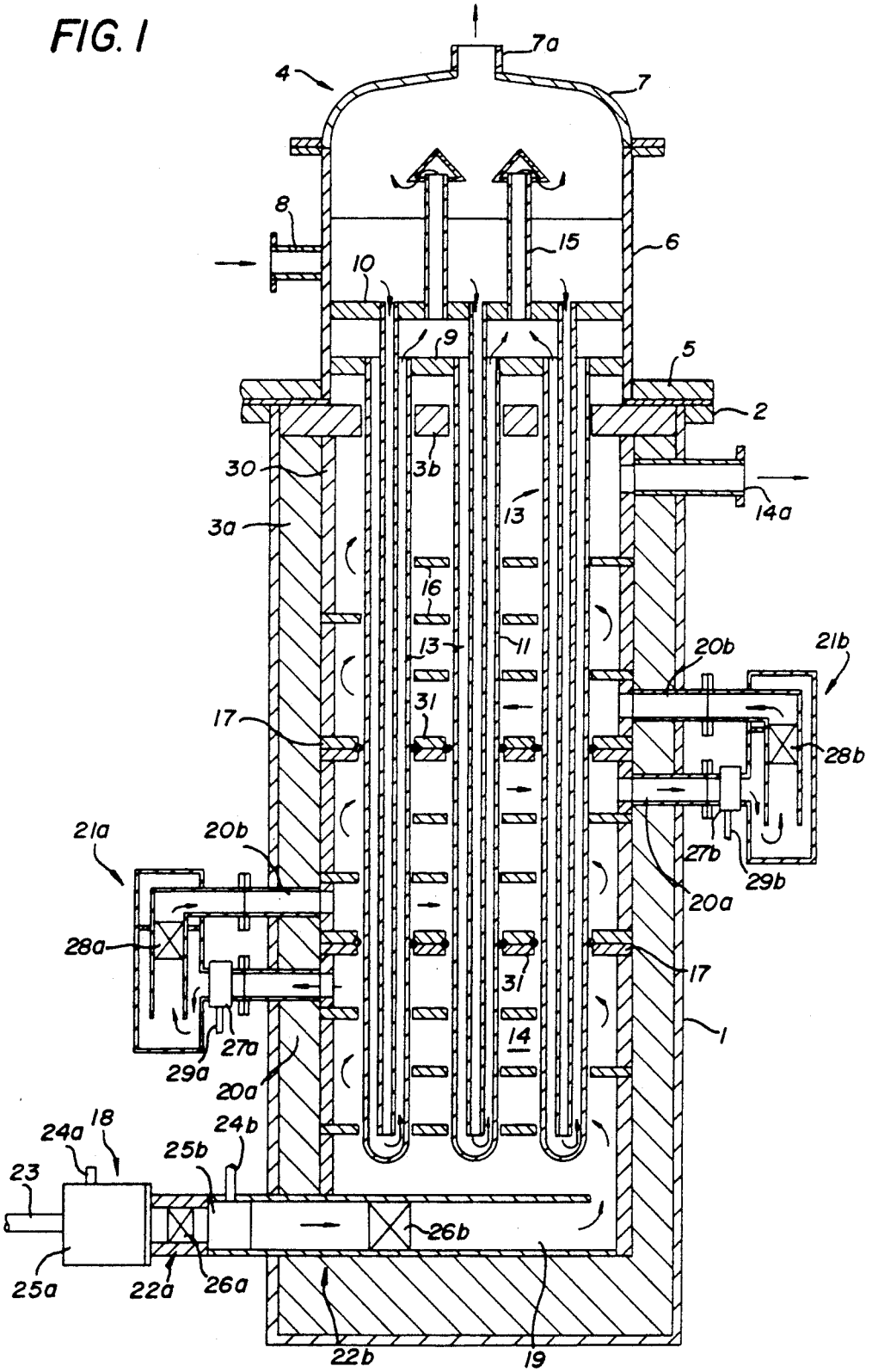
FIG. 1 is a schematic longitudinal sectional view showing a first embodiment of the present invention.

Several preferred embodiments of the present invention will be described in detail hereafter with reference to the accompanying drawings.

FIG. 1 thru FIG. 4 show an embodiment of a boiler. A reference numeral 1 in these figures indicates an outer casing with a bottom which has an upper part opened and a flange 2 attached fixedly to this opened end, and a heat insulator 3*a* on the inner face of this outer at the open end thereof so as to close the open end.

4 indicates a cover body fixedly attached to the open end of the outer casing 1, and this cover body 4 consists of a flange 5 fixedly attached airtightly to the flange 2 of the outer casing 1, a cylindrical body 6 fixedly attached to this flange 5 and a cover 7 fixedly attached to the upper side of this cylindrical body 6 airtightly through the flange and formed in a cap shape, and an inlet 8 is provided on the side surface of this cylindrical body 6 and an outlet 7a is provided on the top portion of the cover 7, respectively. A first can plate 9 and a second can plate 10 are fixedly attached being separated vertically from each other on a lower side of the inlet 8 of the cylindrical body 6. Opening end portions of a plurality of heating outer pipes 11 with bottoms having upper ends opened are fixedly attached to the first can plate 9 located on the lower side, and one end portions of a plurality of inner pipes 13 having both ends opened are fixedly attached to the second can plate 10 located on the upper side. The heating outer pipes 11 are extended into a heating chamber 14 formed in the outer casing 1, and each of inner pipes 13 is inserted into each of the heating outer pipes 11 without making contact therewith. Respective heating outer pipes 11 are disposed at locations having predetermined spaces therebetween in diametral directions in the heating chamber 14. Further, respective heating outer pipes 11 penetrate through the thermal insulator 3b which closes the open ends of the outer casing 1. A plurality of chimneys 15 are provided on the second can plate 10, and these chimneys 15 are opened toward the upper part of the cover body 4. The heating chamber 14 is partitioned in a labyrinth form in upward and downward directions by means of a plurality of baffles 16. Further, partition plates 17 which partition the labyrinth in upward and downward directions are provided at several locations on the way of the labyrinth by means of these baffles 16, respectively.

A combustion gas inflow port 19 of a main catalytic combustion equipment 18 is opened, a lowest end portion of the labyrinth formed by the baffles 16 at the bottom portion of the heating chamber 14. Further, passages 20a and 20b which communicate with the outside are provided on the sidewalls located above and below the respective partition plates 17, respectively, and auxiliary catalytic combustion equipments 21a and 21b provided outside of the outer casing 1 are interposed between both passages 20a and 20b. An exhaust gas outlet 14a is further provided at an upper end portion of the heating chamber 14.

The main catalytic combustion equipment 18 consists of a first stage combustion equipment 22a and a second stage combustion equipment 22b, and the first stage combustion equipment 22a consists of a mixer 25a having a preheated air inlet 23 and a fuel inlet 24a and a combustion catalyzer 26a located on a downstream side of a mixed gas outlet of the mixer 25a. Further, the second stage combustion equipment 22b is located on the downstream side of the combustion catalyzer 26a of the first stage combustion equipment 22a and consists of a mixer 25b having a fuel inlet 24b and a combustion catalyzer 26b located on the downstream side of the mixer 25b.

Auxiliary catalytic combustion equipments 21a and 21b consist of mixers 27a and 27b and combustion catalyzers 28a and 28b, respectively, and the mixers 27a and 27b are connected to the passage 20a on the lower side (upstream side) of the partition plates 17, 17, and combustion catalyzers 28a and 28b are connected to the passage 20b on the upper side (downstream side). Fuel supply pipes 29a and 29b are connected to both mixers 27a and 27b, respectively.

Figure 2:
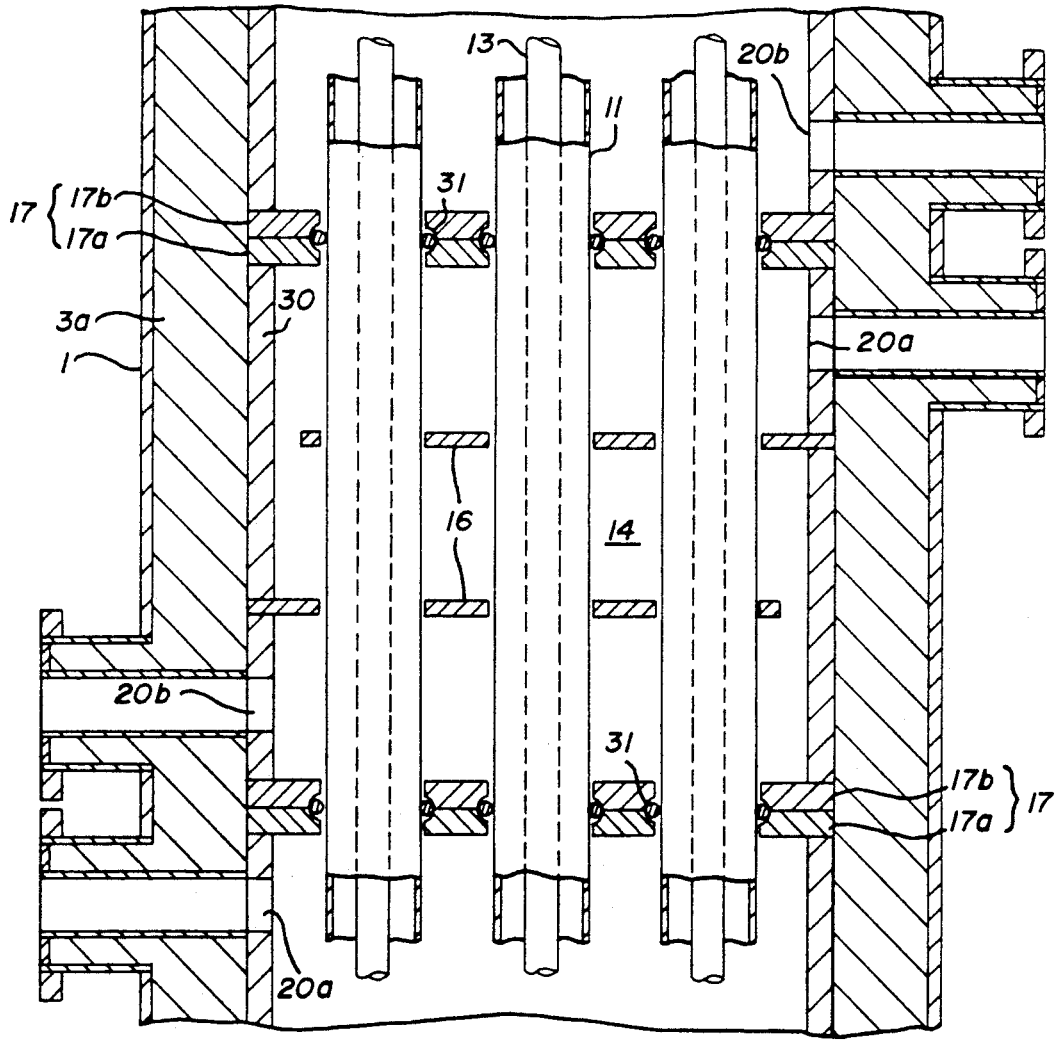
FIG. 2 is an enlarged longitudinal sectional view showing a partition plate portion of the first embodiment.

The outer peripheral portions of the baffle plates 16 and partition plates 17 are supported by a sleeve 30 provided on the inner side of the thermal insulator 3a of the outer casing 1 as shown in FIG. 2. Further, the partition plate 17 consists of two sheets of plate materials 17a and 17b which are placed vertically one upon another, and a sealant 31 which seals the outer peripheral portions of the outer pipes 11 is held between these plate members 17a and 17b. This holding portion is formed in a groove shape, and the sealant 31 in a doughnut shape is held in this groove portion.

Figure 3:
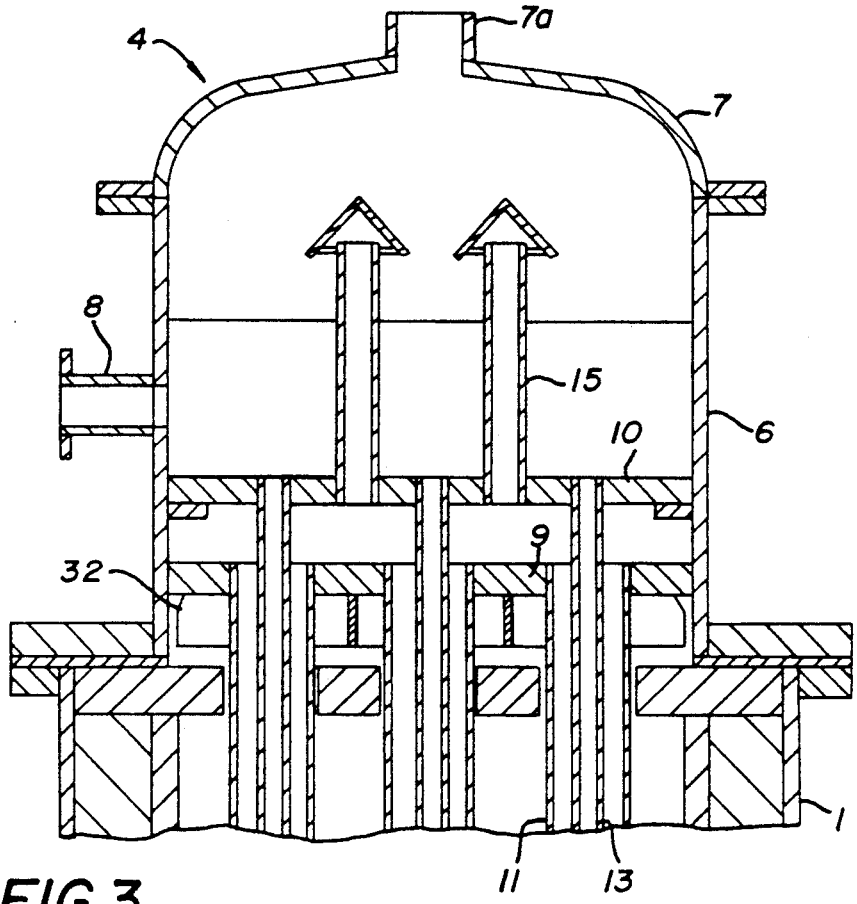
FIG. 3 is an enlarged longitudinal sectional view showing a cover body and a can plate portion of the first embodiment.
Figure 4:
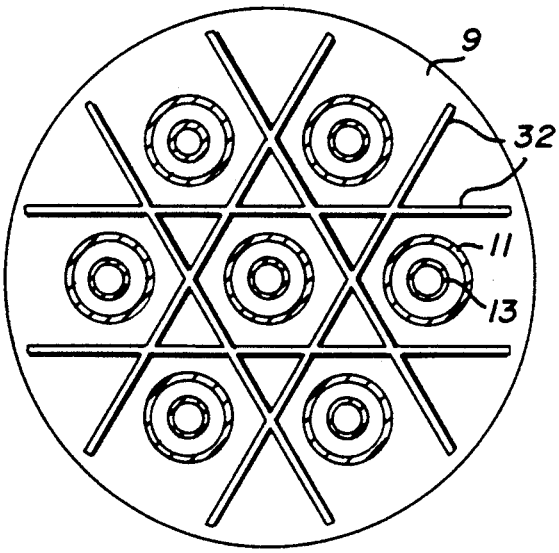
FIG. 4 is a bottom view of a first can plate of the first embodiment.

Since the first can plate 9 which closes the upper side of the heating chamber 14 receives an internal pressure of the heating chamber 14, equivalent strength is required. In case the pressure in the heating chamber is high, the plate thickness has to be made thicker since the first can plate 19 is a plate. Therefore, increase in the plate thickness is controlled by providing a rib 32 on the underside of the first can plate 9 as shown in FIG. 3 and FIG. 4.

With the construction described above, preheated air is supplied from the preheated air inlet 23 and fuel is supplied from the fuel inlet 24, thereby to effect combustion at 750°-900° C. in the first stage combustion equipment 22a first in the main catalytic combustion equipment 18. Then, the combustion gas is mixed with fuel again in the second stage combustion equipment 22b so as to effect combustion at 1,250°-1,350° C. there, and the combustion gas is made to flow into the lower end portion of the labyrinth formed in the heating chamber 14 through the combustion gas inflow port 19.

The combustion gas from the main catalytic combustion equipment 18 flows through the labyrinth of the heating chamber 14, and heats the heating outer pipes 11 in the heating chamber 14 from the outside thereof. Then, the heating gas which flows through the labyrinth of the heating chamber 14 is guided by the passage 20a at a position where the partition plate 17 is provided, and is burnt and heated in the auxiliary catalytic combustion equipments 21a and 21b successively.

Namely, the combustion gas at 1,250°-1,350° C. which has flown into the bottom portion of the heating chamber 14 is deprived of heat by the heating outer pipes 11 while ascending in the labyrinth and the temperature falls, thus reaching a temperature of about 750°-800° C. at the portions partitioned by the partition plates 17. Further, the combustion gas which has reached such a low temperature is heated by recombustion in the first auxiliary catalytic combustion equipment 21a so as to become a combustion gas at 1,250°-1,350° C., and flows into the upper side of the partition plates 17 again through the passage 20b. This operation is repeated successively in the second auxiliary catalytic combustion equipment 17b and thereafter, and the combustion gas is discharged at a low temperature of about 600° C. from the exhaust gas outlet 14a provided at the upper end portion of the heating chamber 14. Thus, the heating outer pipes 11 are heated from the outside during this period.

Besides, fuel is supplied to respective mixers 25b, 27a and 27b of catalytic combustion equipments at the second stage and thereafter.

Air is supplied only through the preheated air inlet 23 of the main catalytic combustion equipment 18 in the combustion heating operation, and oxygen in the air is consumed in combustion equipments on downstream side successively. Thus, residual oxygen in the exhaust gas discharged from the exhaust gas outlet 14a of the heating chamber 14 becomes almost zero. A heat exchanger (not shown) for preheating air which is supplied to the main catalytic combustion equipment 18 is provided on an outflow channel of the exhaust gas which is discharged from the exhaust gas outlet 14*a*, where the preheating air is preheated. With this, sensible heat in the exhaust gas is recovered, and the thermal efficiency of the whole heating equipment becomes about 94%.

Further, since the temperature of the combustion gas is about 1,350° C. at the highest, almost no pollution material $NO_x$ is generated in the combustion gas. Thus, it is not required to provide a denitration device in the exhaust gas channel.

On the other hand, water is supplied at this time through an inlet 8 provided on the cylindrical body 6 forming the cover body 4. This water flows down to the bottom portions of the heating outer pipes 11 through inner pipes 13 which are fixedly attached to the second can plate 10, ascends in the heating outer pipes 11, and reaches to between the first can plate 9 and the second can plate 10. The water becomes vapor by heating from the heating chamber 14 during this period. This vapor passes through the top portion of the cover body via chimneys 15 provided on the second can plate 10. At this time, vapor carrying liquid ascends from the chimneys 15, and vapor flows out as it is through an outlet 7*a* and water drops onto a hot water residence portion on the second can plate 10.

The reason why the main catalytic combustion equipment 18 is formed in two stages is for effecting low temperature combustion by preheated air and high temperature combustion by the combustion gas. Platinum and palladium, etc. are used for the combustion catalyzer 6*a* used in the first stage combustion equipment 22*a*for the purpose of ignition at a low temperature, and fuel containing no sulfur content, etc. which becomes a catalytic poison is used. Besides, since a vapor catalyzer has a short life time at 1,000° C. and higher and cannot fit for use for a long period of time, it is used at 900° C. and lower.

A combustion gas at a high temperature from the first stage combustion equipment 22*a* flows into the second stage combustion equipment 22*b*. Therefore, only a monolith of silicon carbide will suffice for the combustion catalyzer 26*b* used therein, and catalytic combustion is generated only on the wall surface of silicon carbide. For example, when the fuel is kerosene, contact combustion occurs at 700° C. and higher.

Since the second stage combustion catalyzer 26*b* generates contact combustion on the wall surface thereof, no deterioration is generated as a catalyzer, there is no fear about the life time at 1,350° C. and lower, fuel containing a catalyzer poison such as sulfur content, etc. can also be used, and fuel cost is curtailed, too.

Plate materials of heat resistance ceramics such as $\beta$-cordierite are used for the baffles 16 and the partition plates 17 in case of ceramic-made, for example, at a temperature of 1,300° C. and lower. Further, the sealing member 31 in a doughnut form interposed between the partition plates 17 and the outer pipes 11 is composed in such a manner that ceramic fabrics, for example, ceramic fibers (brandname: NEXTEL) composed of three components of alumina, boria and silica are placed one upon another and sewed together. Besides, a doughnut ring in which ceramic fibers are stuffed inside a cylindrical net made of ceramic fibers may also be used for the same purpose.

Under an operating state, the temperature of the outer pipes 11 rises, and the outer pipes 11 expand both in length direction and diametral direction.

The ceramic baffles 16 also show thermal expansion at this time, however, the expansion is small. Therefore, deformation in a diametral direction acts to bind the sealing function.

Since the heating outer pipes 11 also expand thermally in a longitudinal direction, the sealing ring 31 moves relatively in an axial direction of the pipes 11.

Next, heat utilization of a combustion gas in the heating chamber 14 will be explained.

The comparison between a case of a heating equipment of the first stage combustion only in which the utilization temperature of a combustion gas is set from 1,300° C. to 600° C. for instance and a case of a heating equipment in which three stage combustion is adopted, the first stage and the second stage combustion gases are set from 1,300° C. to 800° C., and the third stage combustion gas is set from 1,300° C. to 600° C. shows as follows.

When it is assumed that a heat transfer coefficient between heating pipes (heating outer pipes 11) and a material to be heated and a heat transfer coefficient between the combustion gas and heating pipes are equal to each other, the heat transfer quantity becomes a function of a temperature difference $\Delta T$ between the combustion gas and the surface of heating pipes.

When the heated side is made constant at an evaporation temperature of 365° C. of water in 200 Kg/cm$^2$, the average temperature difference becomes approximately 506° C. in the case of a heater of one-stage combustion, and the average temperature difference becomes approximately 600° C. in the case of a heater of three-stage combustion.

Accordingly, the heat transfer area of the heating outer pipes needs to be 506/600≈0.843, viz., approximately 85% only, thus making it possible to miniaturize the equipment.

The foregoing will become apparent from the following description.

Namely, in the case of a heater of one-stage combustion:

$$\Delta T_1 = 1{,}300 - 365 = 935$$

$$\Delta T_2 = 600 - 365 = 235$$

$$T_m = \frac{(935 - 235)}{L_n\,(935/235)} = 506.9$$

where $\Delta T_1$ and $\Delta T_2$ are temperature difference between the inside and the outside of the heating outer pipes 11 when temperature in the heating chamber are at 1,300° C. and 600° C., respectively, and 365° C. is the evaporating temperature of water in 200 Kg/cm$^2$.

In a heater of three-stage combustion:

$$\Delta T_1 = 1{,}300 - 365 = 935$$

$$\Delta T_2 = 600 - 365 = 235$$

$$T_m = \frac{(935 - 235)}{L_n\,(935/235)} = 506.9$$

$$\Delta T'_1 = 1{,}300 - 365 = 935$$

$$\Delta T'_2 = 800 - 365 = 435$$

$$T'_m = \frac{(935 - 435)}{L_n\,(935/435)} = 653.4$$

The overall average temperature difference $\Delta T_{mT}$ is obtained as:

$$T_{mT} = \frac{\Delta T_m + 2 \times \Delta T'_m}{3} = 604.5$$

The heat transfer area of the heating outer pipes 11 becomes 506.9/604.5=0.838. That is, approximately 85% will suffice, and hence, the equipment is miniaturized.

In the above description, $\Delta T'_1$ and $\Delta T'_2$ indicate temperature differences between the inside and the outside of the heating outer pipes 11 at the high temperature and the low temperature portions in the heated portions by the combustion gas from the main catalytic combustion equipment 18 and the first auxiliary catalytic combustion equipment 21*a* in the embodiment shown in FIG. 1, respectively. Further, $\Delta T''_1$ and $\Delta T''_2$ indicate temperature differences at the high temperature and the low temperature portions of the heated portions by the combustion gas from the second auxiliary catalytic combustion equipment 21*b*, respectively.

Figure 5:
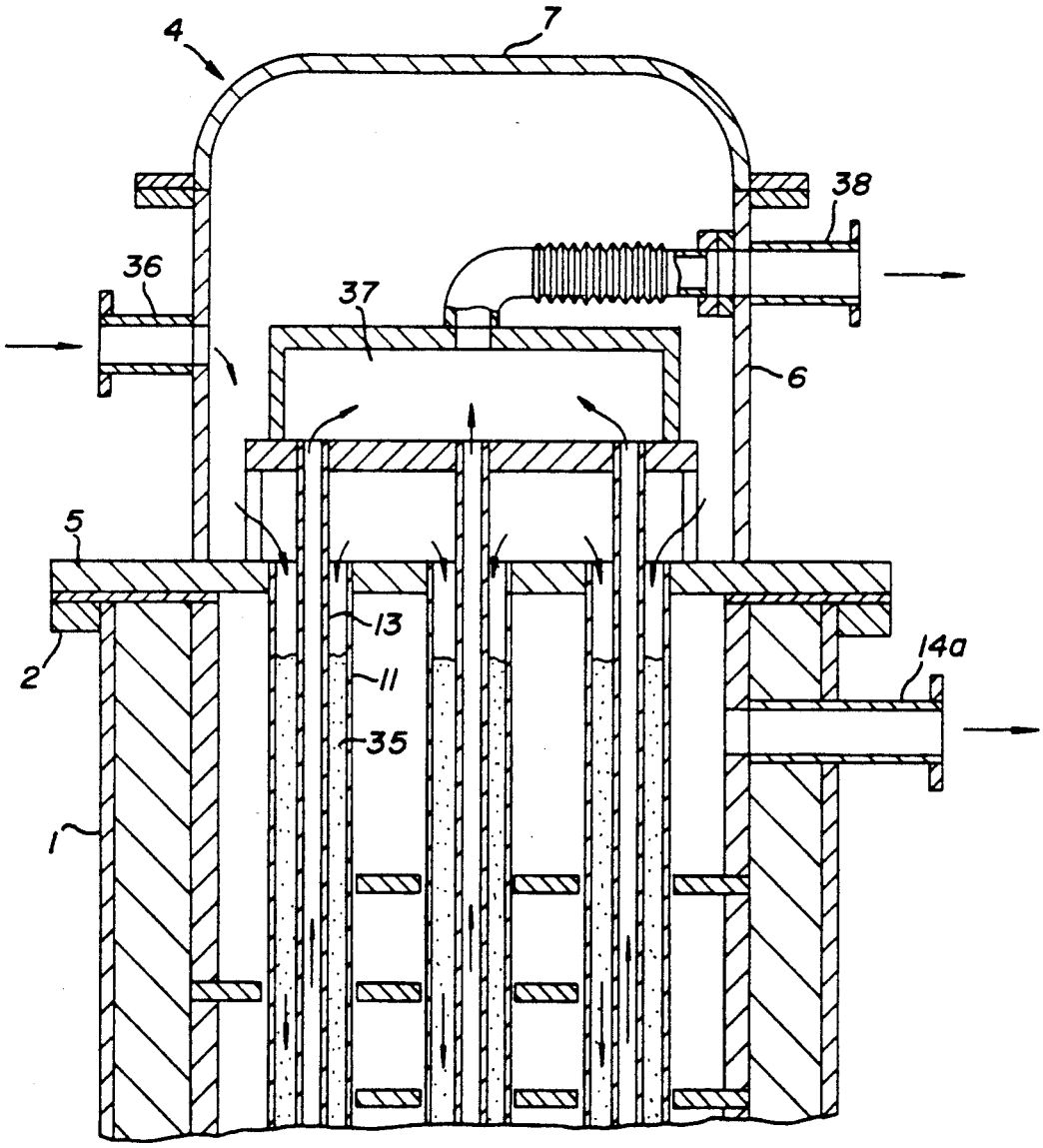
FIG. 5 is a longitudinal sectional view showing another embodiment in which a cover body is used as a reactor.

Other modes of embodiments of the present invention will be shown in FIG. 5 and thereafter.

FIG. 5 shows a case in which a heating equipment is used as a reactor by filling a catalyzer 35 in a space in a doughnut form between the heating outer pipes 11 and the inner pipes 13.

A feed gas which has flown in through a feed gas inlet 36 reacts while being heated and while descending in the doughnut rings filled with the catalyzer 35. The reaction product gas completed with reaction ascends in the inner pipes 13 and enters into a reaction generating gas collecting chamber 37, and is then derived outside through an outlet pipe 38.

Figure 6:
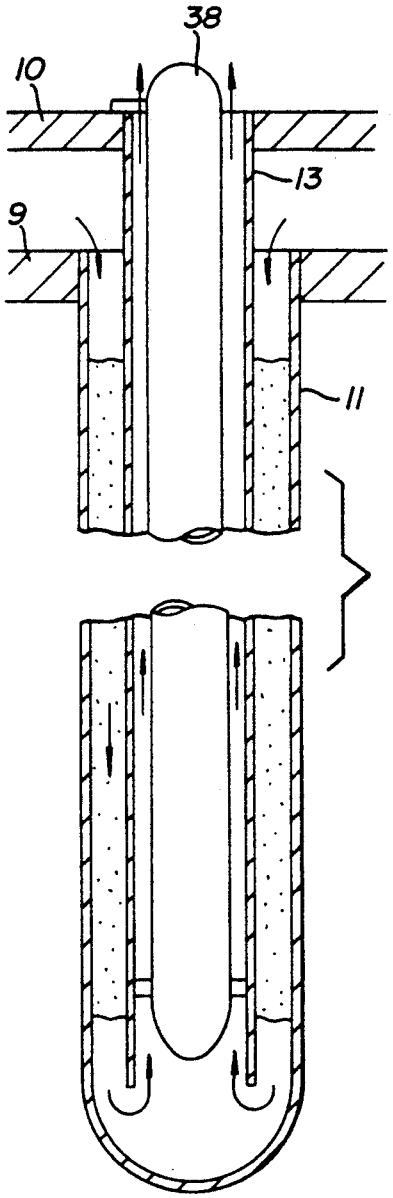
FIG. 6 and FIG. 7 are a partly omitted longitudinal sectional view showing another embodiment of a heating outer pipe and a top plan view thereof.
Figure 7:
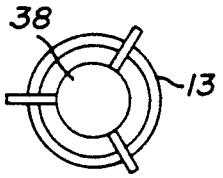

The reaction product gas which ascends in the inner pipes 13 recovers heat by heat exchange with the feed gas which descends in the doughnut rings while ascending in the inner pipes 13. In this case, it is effectual to increase the flow velocity of the gas by inserting the inner pipe 38 inside the inner pipe 13 without making contact with the inner pipe 13 as shown in FIG. 6 and FIG. 7.

In the case of this embodiment, a stiffening ri*b* is not required for the first can plate 9 since the pressure is comparatively low.

Figure 8:
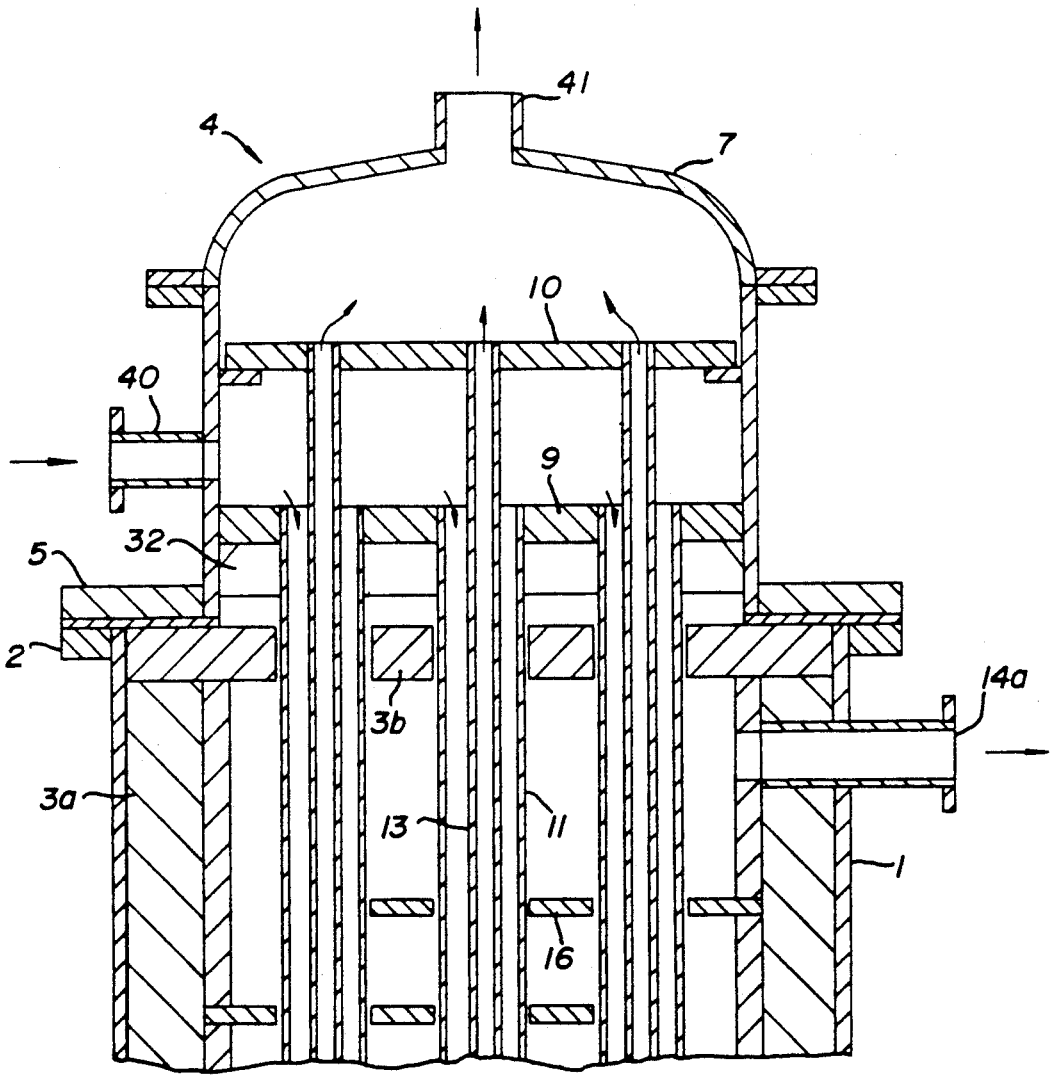
FIG. 8 is a longitudinal sectional view of a principal part showing still another embodiment used as a thermal decomposition furnace of a high pressure gas.

FIG. 8 shows an embodiment when the handling gas is at a high pressure, which is used as a thermal decomposition furnace which does not require catalyzer such as a vapor superheater or a ethylene decomposition furnace, etc.

In case of use as a vapor superheater, vapor at a low temperature supplied from a vapor inlet 40 is heated while descending in the passages each having a doughnut ring form formed by the heating outer pipes 11 and the inner pipes 13, ascends in the inner pipes 13 after making U turn at the lower ends of the heating outer pipes 11, and is derived out from an outlet 41.

In this case, the second can plate 10 which fixes the inner pipes 13 may be a comparatively thin plate because the pressure difference between the inlet and the outlet is only the pressure difference for the pressure loss portion of the vapor passage of the heater.

The vapor reaction gas which has reached a high temperature at lower points of the heating outer pipes 11 is lowered in temperature by heat exchange with the vapor (feed gas) at the inlet on the wall surfaces of the inner pipes 13. Thus, it is required to heat the vapor up to a temperature higher than the required temperature by the temperature drop portion.

Figure 9:
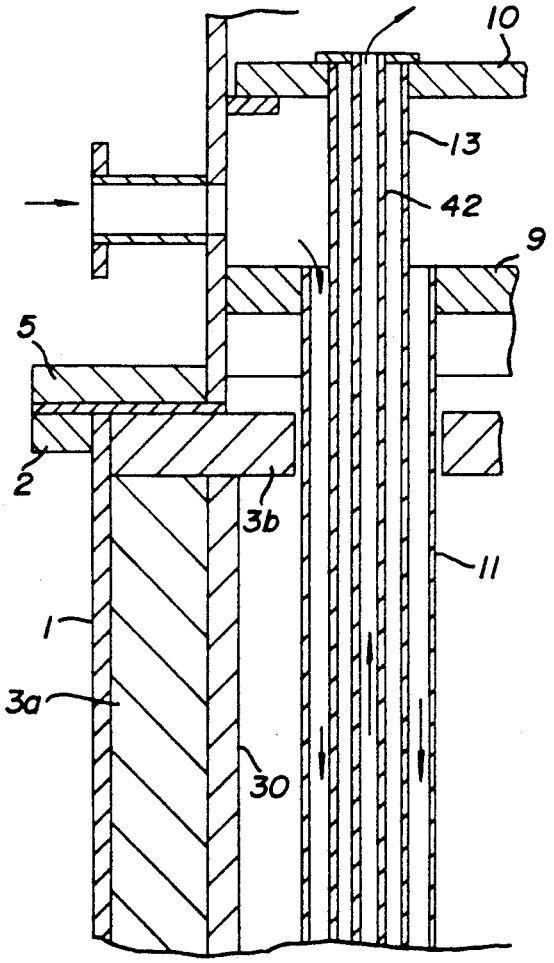
FIG. 9 is a longitudinal sectional view of a principal part showing a modified example of the heating outer pipe used in the embodiment shown in FIG. 8.

In case the required temperature is high (800°-850° C.), since the skin temperature of the heating outer pipes 11 is restricted, the combustion temperature has to be lowered and the heat transfer area has also to be made large. Thus, it is preferable to install an inner insertion pipe 42 as shown in FIG. 9.

Figure 10:
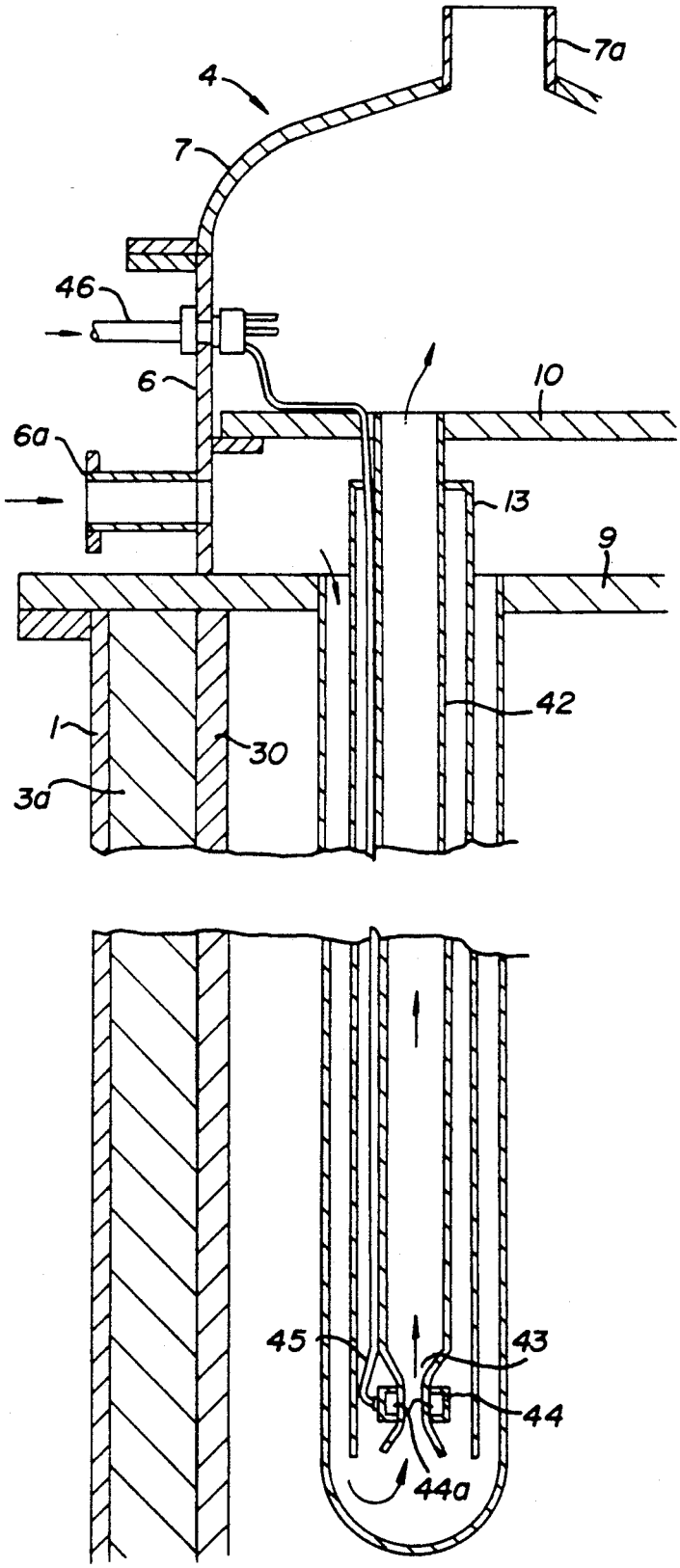
FIG. 10 is a longitudinal sectional view of a principal part showing still another embodiment used as a decomposition furnace of a reaction product gas.

FIG. 10 shows another embodiment which is used for the purpose of preventing a side reaction by quenching the reaction product gas such as an ethylene decomposition furnace. The inner insertion pipe 42 with upper and lower ends opened is inserted in the inner pipe 13 and the upper end of the inner pipe 13 is closed at the same time. Further, the lower end portion of the inner insertion pipe 42 is drawn and a cooling medium chamber 44 communicating with the inside of a drawn portion 43 through a nozzle 44*a* is provided on the outside periphery of this drawn portion 43. This cooling medium chamber 44 is connected to a cooling medium supply pipe 46 through a cooling medium pipe 45.

The feed gas which has flowed in from an inflow port 6*a* is heated to a predetermined temperature while ascending in the heating outer pipes 11, and makes U turn at the lower points of the heating outer pipes 11 after securing required residence time (reaction time).

The upper end of the inner pipe 13 being closed, the reaction product gas flows in the pressed portion 43 at the point of the inner insertion pipe 42 and raises this inner insertion pipe 42. At this time, a cooling medium (water) is sprayed from a nozzle 44*a* to the inside of the drawn portion 43, which is cooled by the cooling medium by the latent heat when the cooling medium is vaporized. Thus, the reaction product gas is quenched while passing through the drawn portion 43.

This quenching temperature is a temperature at which a side reaction can be prevented, and it is preferable to set it at such a high temperature (250°-300° C.) that makes it possible to make the device for heat recovery on the downstream side as small as possible.

In case water is used as the cooling medium, the latent heat is large. Accordingly, small quantity will suffice and the temperature of the reaction product gas can be controlled easily by controlling the quantity of water.

I claim:

1. A heating apparatus consisting of a heating chamber with a bottom having an opening portion in an upper part thereof, a cover body provided at the top portion of said heating chamber, a plurality of heat-exchanger pipe bodies inserted along a vertical direction at predetermined intervals in said heating chamber in diametral directions of the heating chamber, a can plate provided in the lower part of said cover body so as to block the opening portion of said heating chamber and also to support said pipe bodies, a plurality of sheets of baffle plates arranged so as to form a labyrinth stretching vertically in a row in said heating chamber and having said pipe bodies penetrate therethrough, a combustion gas inflow port provided at a bottom portion of the heating chamber on a sidewall adjacent to said bottom portion and having an opening portion at the bottom portion of said heating chamber and an exhaust gas outflow port provided in an upper part of said heating chamber on a sidewall adjacent to said upper part and having an opening portion in the upper part of said heating chamber, comprising:

a main catalytic combustion equipment located outside of said heating chamber and connected to said combustion gas inflow port;

a plurality of partition plates provided in said heating chamber so as to partition said labyrinth into a plurality of chambers vertically; and a plurality of auxiliary catalytic combustion equipments provided so as to connect said chambers on the lower side and the upper side of respective partition plates.

2. A heating apparatus according to claim 1, characterized in that said main catalytic combustion equipment is composed of a first stage combustion equipment consisting of a first mixer for mixing preheated air and fuel with each other and a first combustion catalyzer disposed on a downstream side of a mixed gas outlet of said first mixer and a second stage combustion equipment consisting of a second mixer disposed on a downstream side of said first combustion catalyzer for mixing the combustion gas from said first stage combustion equipment and fuel with each other and a second combustion catalyzer disposed on a downstream side of the mixed gas outlet of said second mixer.

3. A heating equipment according to claim 1, characterized in that each of said auxiliary catalytic combustion equipments is composed of a passage for flowing the combustion gas out of a chamber located under said partition plates, a mixer provided on the way of said passage so as to mix fuel with the outflow combustion gas, a combustion catalyzer arranged on a downstream side of a mixed gas outlet of said mixer, and a passage for having a heating combustion gas which has passed through said combustion catalyzer flow into a chamber located above said partition plates.

4. A heating apparatus according to claim 1, characterized in that said can plate has a stiffening rib on the underside thereof.

5. A heating apparatus according to claim 1, characterized in that said can plate consists of a first can plate provided in the vicinity of the lower end of the cover body so as to support upper parts of respective heat-exchanger pipe bodies fixedly and a second can plate provided in said cover body which is apart upwardly by a predetermined distance from said first can plate.

6. A heating apparatus according to claim 5, characterized in that each of said heat-exchanger pipe bodies consists of a heating outer pipe with a bottom which is fixedly attached to said first can plate at the upper end thereof so as to include upper opening ends in the same plane as the upper surface of said first can plate and hung vertically therefrom into said heating chamber and an inner pipe having an opened lower end which is fixedly attached to said second can plate at the upper end thereof so as to include the upper opening end in the same plane as the upper face of said second can plate and hung vertically therefrom into said heating outer pipe without making contact with this outer pipe.

7. A heating apparatus according to claim 6, characterized in that said inner pipe is provided with an inner pipe which is hung vertically inside from the upper opening end thereof without making contact with the inner pipe.

8. A heating apparatus according to claim 6, characterized in that said inner pipe is provided with an inserted inner pipe having opening ends at upper and lower ends which is hung inside the inner pipe from the upper opening end without making contact therewith. that a ring-shaped space formed between said inserted inner pipe and said inner pipe is blocked at least at the upper end thereof, and that the upper opening end of said heating outer pipe is communicated with a feed gas inflow side, and on the other side, the upper opening end of said inserted inner pipe is communicated with a reaction product gas outlet side, respectively.

9. A heating apparatus according to claim 8, characterized in that said inserted inner pipe is provided with a drawn portion formed on an inner circumferential surface at the lower end of the inserted inner pipe, a cooling medium chamber provided on the outside circumference of said drawn portion so as to communicate with the drawn portion through a nozzle, and a cooling medium pipe connected between said cooling medium chamber and a cooling medium supply pipe or supplying the cooling medium to said cooling medium chamber.

* * * * *